US009867444B1

(12) United States Patent
Liu et al.

(10) Patent No.: US 9,867,444 B1
(45) Date of Patent: Jan. 16, 2018

(54) COSMETIC PEN HAVING A SEALING ARRANGEMENT

(71) Applicants: Li-Mei Liu, New Taipei (TW); Jun Zhang, Zhuhai (TW)

(72) Inventors: Li-Mei Liu, New Taipei (TW); Jun Zhang, Zhuhai (TW)

(73) Assignee: ZHUHAI DING RONG PLASTIC PRODUCTS CO., LTD, Zhuhai (CN)

( * ) Notice: Subject to any disclaimer, the term of this patent is extended or adjusted under 35 U.S.C. 154(b) by 15 days.

(21) Appl. No.: 15/199,593

(22) Filed: Jun. 30, 2016

(51) Int. Cl.
*B43K 5/00* (2006.01)
*A45D 34/04* (2006.01)
*A46B 11/00* (2006.01)

(52) U.S. Cl.
CPC ..... *A45D 34/042* (2013.01); *A46B 11/0041* (2013.01); *A46B 11/0086* (2013.01); *A46B 11/0089* (2013.01)

(58) Field of Classification Search
CPC ..... A45D 34/042; A46B 11/0041; A46B 11/0085; A46B 11/0089
USPC ..... 401/202, 206
See application file for complete search history.

(56) References Cited

U.S. PATENT DOCUMENTS 6,102,602 A * 8/2000 Kageyama ..... A45D 34/042 401/202
7,175,360 B2 * 2/2007 Zhang ..... A45D 34/04 401/186
7,377,711 B2 * 5/2008 Byun ..... A45D 34/042 401/269
7,988,377 B2 * 8/2011 Zhang ..... A45D 40/24 401/186
9,185,959 B2 * 11/2015 Pires ..... A45D 34/042
2017/0035181 A1 * 2/2017 Hwang ..... A46B 9/021

* cited by examiner

*Primary Examiner* — Jennifer C Chiang

(57) ABSTRACT

A cosmetic pen includes a hollow cap; a hollow plunger including, on an outer surface, a front annular groove, an annular flange configured to urge against an internal shoulder of the hollow cap, a rear tubular member, and an annular projection; a hollow conic member urging against the annular flange; an applicator; a biasing member put on the tubular member and having a front end urging against the annular projection; a hollow valve put on both the annular projection and the biasing member, the hollow valve including rear outlet ports; a hollow member fastened in the hollow cap; a sealing ring disposed tightly between a front end of the hollow plunger and an inner surface of the hollow conic member; and a pen tube. Airtightness of the pen tube is sound in a closed state.

7 Claims, 3 Drawing Sheets

COSMETIC PEN HAVING A SEALING ARRANGEMENT

BACKGROUND OF THE INVENTION

1. Field of the Invention

The invention relates to cosmetic pen and more particularly to a cosmetic pen including a plunger having an annular projection compressing a biasing member in a valve to urge a rear end of the plunger against a rear end of the valve in a closed state so as to maintain a sound airtightness of cosmetic liquid in a pen tube.

2. Description of Related Art

There is a great array of cosmetic pens commercially available. For example, a conventional cosmetic pen developed by the present inventor is shown in FIGS. 5 and 6 and comprises a hollow valve 100 including an axial space 101, a shoulder 102 on an inner surface, and two opposite outlet ports 103 at a rear end; a plunger 104 including, on an outer surface, a snapping portion 107 at a front end, an annular flange 105 adjacent to the snapping portion 107, a rear tubular member 106 spaced from the flange 105, and an annular projection 120 spaced from the flange 105 and abutted on the tubular member 106, the plunger 104 further including an annular protuberance 1041 on an inner surface and adjacent to the flange 105; a torsion spring 113 put on the tubular member 106 and having a front end urging against the projection 120 and a rear end urging against a bottom of the space 101; a hollow conic member 108 having an enlarged rear end 109 gripping the snapping portion 107 and urging against the flange 105; and an applicator 111 having a tapered front end passing through both the plunger 104 and the conic member 108 to be secured thereto, the applicator 111 including an annular groove 112 adjacent to a rear end, the annular groove 112 being complimentarily engaged the protuberance 1041 to aid the fastening of the applicator 111 and the plunger 104.

In a closed state of the cosmetic pen, a cap is threadedly secured to an externally threaded front end of a pen tube, the projection 120 compresses the torsion spring 113 to urge the rear end of the tubular member 106 against a rear end of the valve. Thus, the cosmetic liquid stored in the pen tube is prevented from leaving the applicator 111 via the outlet ports 103.

However, the sealing arrangement of the conventional cosmetic pen is not reliable and thus the applicator may contact air to be oxidized and the cosmetic liquid may degrade.

Thus, the need for improvement still exists.

SUMMARY OF THE INVENTION

It is therefore one object of the invention to provide a cosmetic pen comprising a hollow cap including a rear opening and an annular shoulder on an inner surface; a hollow plunger including, on an outer surface, a front annular groove, an annular flange adjacent to the annular groove and being configured to urge against the annular shoulder, a rear tubular member, and an annular projection spaced from the annular flange and abutted on the tubular member; a hollow conic member having an enlarged rear end urging against the annular flange; an applicator passing through both the hollow plunger and the hollow conic member to be secured thereto; a biasing member put on the tubular member and having a front end urging against the annular projection; a hollow valve put on both the annular projection and the biasing member, the hollow valve including an internal shoulder urging against a rear end of the biasing member, and a plurality of rear outlet ports adjacent to a rear end of the applicator in the hollow plunger; a hollow member disposed in the hollow cap and having a front end engaged a blind end of the hollow cap, the hollow member including a flexible, rear annular recess urging against both a tapered front end of the hollow conic member and an inner surface of the hollow cap; a sealing ring disposed tightly between a front end of the hollow plunger and an inner surface of the hollow conic member; and a pen tube configured to releasably secure to the hollow cap; wherein in a closed state of the cosmetic pen, the annular projection compresses the biasing member to urge a rear end of the hollow plunger against a rear end of the hollow valve.

Preferably, the hollow cap further comprises internal threads forwardly of the rear opening.

Preferably, the pen tube further comprises an externally threaded front end adapted to secure to the internal threads.

Preferably, further comprises a plurality of membranes in the outlet ports respectively, the membranes being allowed to bend inward only.

Preferably, the applicator has a tapered front end.

Preferably, the pen tube is hollow to form a cosmetic liquid storage space.

Preferably, any of other pen tubes are configured to mount on the hollow valve adjacent to the outlet ports as long as it is shaped complementarily to the hollow valve.

The invention has the following advantages and benefits in comparison with the conventional art: The applicator is prevented from contacting air and fluid communication through the outlet ports is impossible in the closed state. Air cannot enter the pen tube to contact the cosmetic liquid in the closed state. The sealing arrangement is reliable.

The above and other objects, features and advantages of the invention will become apparent from the following detailed description taken with the accompanying drawings.

DETAILED DESCRIPTION OF THE INVENTION

Figure 2:
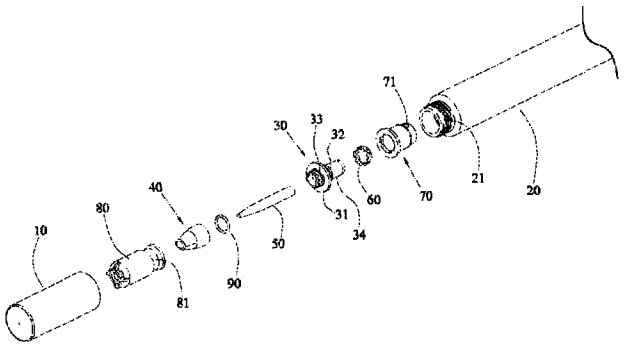
FIG. 2 is an exploded view of the cosmetic pen.
Figure 1:
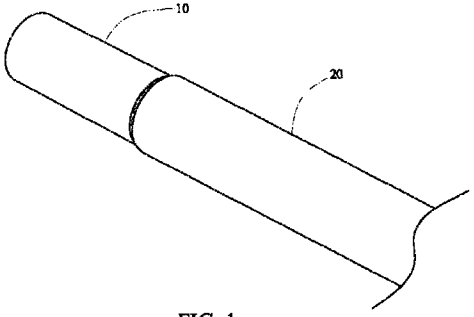
FIG. 1 is a perspective view of a cosmetic pen according to the invention.
Figure 4:
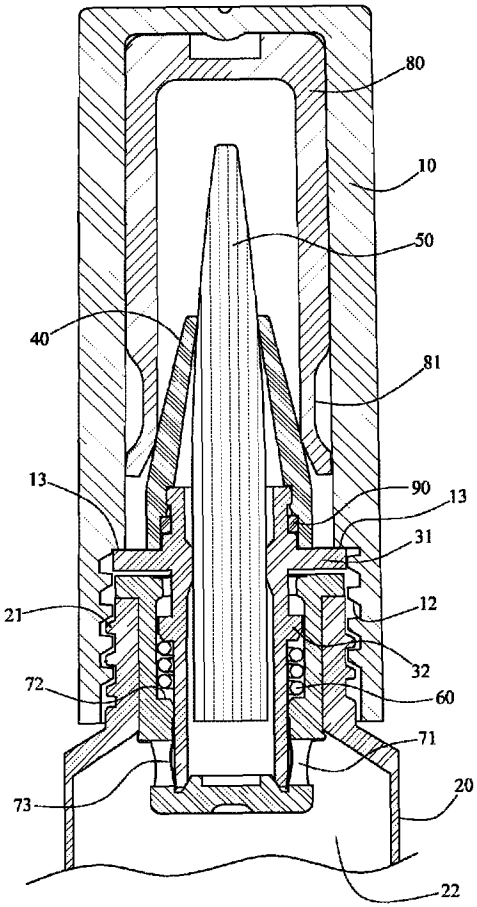
FIG. 4 is a longitudinal sectional view of the cosmetic pen with the hollow cap secured thereto to show its closed state.
Figure 3:
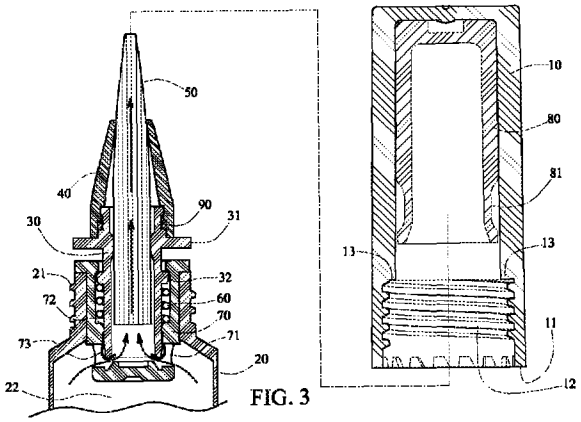
FIG. 3 is a longitudinal sectional view of the cosmetic pen with the hollow cap disengaged to show cosmetic liquid flowing from the pen tube through the applicator for application.
Figure 6:
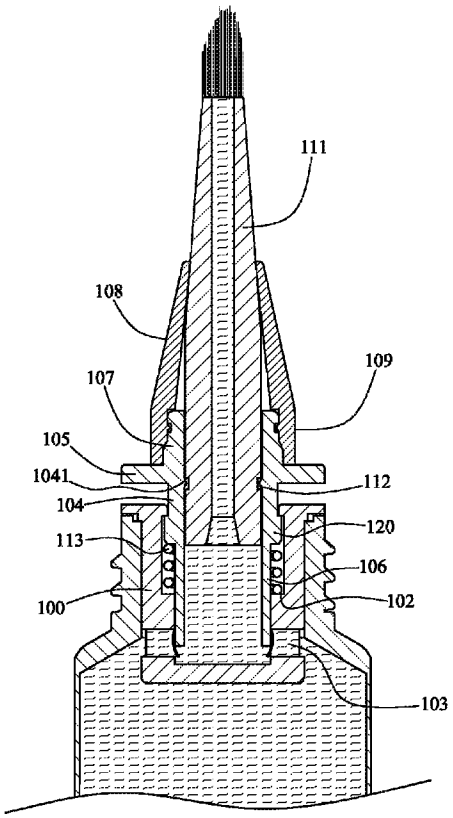
PRIOR ART FIG. 6
FIG. 6 is a longitudinal sectional view of the conventional cosmetic pen showing cosmetic liquid flowing from the pen tube through the applicator for application.
Figure 5:
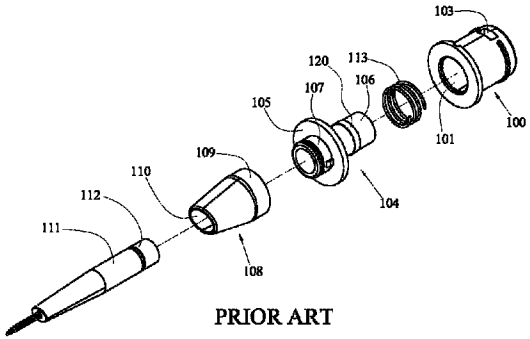
PRIOR ART FIG. 5
FIG. 5 is an exploded view of a conventional cosmetic pen.

Referring to FIGS. 1 to 4, a cosmetic pen in accordance with the invention comprises the following components as discussed in detail below.

A hollow cap 10 includes a rear opening 11, an annular shoulder 13 on an inner surface, and internal threads 12 between the opening 11 and the annular shoulder 13. A hollow plunger 30 includes, on an outer surface, a front annular groove 33, an annular flange 31 adjacent to the annular groove 33 and urging against the shoulder 13, a rear tubular member 34 spaced from the annular flange 31, and an annular projection 32 spaced from the annular flange 31 and abutted on the tubular member 34. A hollow conic member 40 has an enlarged rear end urging against the annular flange 31. A applicator 50 having a tapered front end passes through both the hollow plunger 30 and the hollow conic member 40 to be secured thereto. A biasing member 60 (such as a torsion spring) is put on the tubular member 34 and has a front end urging against the annular projection 32. A hollow valve 70 is put on both the annular projection 32 and the biasing member 60 and includes a plurality of rear outlet ports 71, a plurality of membranes 73 in the outlet ports 71 respectively, the membranes 73 being allowed to bend inward only, and an internal shoulder 72 urging against a rear end of the biasing member 60. That is, the biasing member 60 is biased between the shoulder 72 and the annular projection 32. The outlet ports 71 are adjacent to a rear end of the applicator 50 in the hollow plunger 30. A hollow member 80 is disposed in the cap 10 and has a front end engaged a blind end of the cap 10. The hollow member 80 includes a flexible, rear annular recess 81 urging against both a tapered front end of the hollow conic member 40 and an inner surface of the cap 10 for fastening purpose. A sealing ring 90 is disposed tightly between the front end of the hollow plunger 30 and an inner surface of the hollow conic member 40. A pen tube 20 includes an internal space 22 for storing cosmetic liquid, and an externally threaded front end 21 adapted to secure to the internal threads 12 so that a complete cosmetic pen is assembled.

In a closed state of the cosmetic pen (see FIG. 4), the annular projection 32 compresses the biasing member 60 to urge the rear end of the hollow plunger 30 against both a rear end of the hollow valve 70 and the membranes 73. Thus, the cosmetic liquid stored in the space 22 is prevented from leaving the applicator 50 via the outlet ports 71.

It is envisaged by the invention that any of other pen tubes 20 can be mounted on the hollow valve 70 as long as it is shaped complementarily to the hollow valve 70.

Operation of the invention will be discussed in detail below. A user may rotate the cap 10 to remove it from the pen tube 20. Thus, the compressed biasing member 60 expands to push the hollow plunger 30 forward and in turn an annular gap is formed between the rear end of the hollow plunger 30 and the rear end of the hollow valve 70 and the membranes 73 are bent inward. The pressurized cosmetic liquid in the space 22 flows through the applicator 50 for application via the outlet ports 71 and the gap (see FIG. 3).

While the invention has been described in terms of preferred embodiments, those skilled in the art will recognize that the invention can be practiced with modifications within the spirit and scope of the appended claims.

What is claimed is:

1. A cosmetic pen comprising:

a hollow cap including a rear opening and an annular shoulder on an inner surface;

a hollow plunger including, on an outer surface, a front annular groove, an annular flange adjacent to the annular groove and being configured to urge against the annular shoulder, a rear tubular member, and an annular projection spaced from the annular flange and abutted on the tubular member;

a hollow conic member having an enlarged rear end urging against the annular flange;

a applicator passing through both the hollow plunger and the hollow conic member to be secured thereto;

a biasing member put on the tubular member and having a front end urging against the annular projection;

a hollow valve put on both the annular projection and the biasing member, the hollow valve including an internal shoulder urging against a rear end of the biasing member, and a plurality of rear outlet ports adjacent to a rear end of the applicator in the hollow plunger;

a hollow member disposed in the hollow cap and having a front end engaged a blind end of the cap, the hollow member including a flexible, rear annular recess urging against both a tapered front end of the hollow conic member and an inner surface of the hollow cap;

a sealing ring disposed tightly between a front end of the hollow plunger and an inner surface of the hollow conic member; and a pen tube releasably secured to the hollow cap;

wherein in a closed state of the cosmetic pen, the annular projection compresses the biasing member to urge a rear end of the hollow plunger against a rear end of the hollow valve.

2. The cosmetic pen of claim 1, wherein the hollow cap further comprises internal threads forwardly of the rear opening.

3. The cosmetic pen of claim 2, wherein the pen tube further comprises an externally threaded front end adapted to secure to the internal threads.

4. The cosmetic pen of claim 1, further comprising a plurality of membranes in the outlet ports respectively, the membranes being allowed to bend inward only.

5. The cosmetic pen of claim 1, wherein the applicator has a tapered front end.

6. The cosmetic pen of claim 1, wherein the pen tube is hollow to form a cosmetic liquid storage space.

7. The cosmetic pen of claim 1, wherein any of other pen tubes are configured to mount on the hollow valve adjacent to the outlet ports as long as it is shaped complementarily to the hollow valve.

* * * * *